United States Patent [19]

Vanassche et al.

[11] 4,305,433

[45] Dec. 15, 1981

[54] STEEL CORD FABRIC HAVING SINUSOIDAL WARP CHORDS AND STRAIGHT WEFT CHORDS FOR REINFORCING ELASTOMERIC ARTICLES AND ARTICLES REINFORCED THEREWITH

[75] Inventors: Roger Vanassche; Germain Verbauwhede, both of Zwevegem, Belgium

[73] Assignee: N. V. Bekaert S.A., Zwevegem, Belgium

[21] Appl. No.: 961,866

[22] Filed: Nov. 20, 1978

[30] Foreign Application Priority Data

Nov. 30, 1977 [BE] Belgium ..... 861335
May 23, 1978 [GB] United Kingdom ..... 21601/78

[51] Int. Cl.[3] ..... B29D 29/00; B32B 15/08; B65G 15/34; D03D 15/02

[52] U.S. Cl. ..... 139/425 A; 198/846; 245/2; 428/225; 428/246; 428/258; 428/285; 428/286

[58] Field of Search ..... 140/3 R; 74/237, 239; 245/2; 198/847, 846; 428/225, 229, 246, 257, 286, 258, 285; 139/425 A, 425 R

[56] References Cited

U.S. PATENT DOCUMENTS

| | | | |
|---|---|---|---|
| 2,088,448 | 7/1937 | Specht | 139/425 A |
| 2,332,393 | 10/1943 | Neville | 139/383 A |
| 2,425,575 | 8/1947 | Suloff | 245/2 |
| 2,594,258 | 4/1952 | Smith | 428/258 |
| 2,755,047 | 3/1956 | Henke | 139/425 A |
| 2,992,681 | 7/1961 | Hornbostel et al. | 139/425 A |
| 3,885,603 | 5/1975 | Slaughter | 139/425 A |
| 3,941,162 | 3/1976 | McCabe et al. | 428/258 |
| 3,957,091 | 5/1976 | Bergssens et al. | 428/258 |
| 3,973,670 | 10/1976 | Spaar | 74/237 |
| 3,993,829 | 11/1976 | Park | 428/258 |
| 4,107,371 | 8/1978 | Dean | 428/258 |

FOREIGN PATENT DOCUMENTS

| | | | |
|---|---|---|---|
| 1526176 | 4/1968 | France | 428/258 |
| 1584633 | 11/1969 | France | 428/258 |

*Primary Examiner*—James C. Cannon
*Attorney, Agent, or Firm*—Shlesinger, Arkwright, Garvey & Dinsmore

[57] ABSTRACT

A fabric for reinforcing elastomeric or other plastic materials comprising a steel cord warp and a steel weft wherein the warp cords are substantially sinusoidal and have an elongation of about 1–2% at 10% of the breaking load of the fabric and the weft elements are substantially straight.

11 Claims, 3 Drawing Figures

STEEL CORD FABRIC HAVING SINUSOIDAL WARP CHORDS AND STRAIGHT WEFT CHORDS FOR REINFORCING ELASTOMERIC ARTICLES AND ARTICLES REINFORCED THEREWITH

The present invention relates to fabrics, for the reinforcement of elastomers and like plastics materials, comprising a warp of steel cord and weft elements of steel. The invention also relates to articles reinforced with such fabrics, for instance conveyor belts.

It is known, for example from the British Patent Specification No. 915,159, to reinforce conveyor belts made of rubber and suchlike material with steel wire cables disposed in the longitudinal direction of the belt, and, in order to increase their strength and resistance against lengthwise tearing, to provide steel cords also in the transverse direction in a separate layer over and under a central longitudinal reinforcement layer. However, the application of several layers makes difficult the manufacture of such belts, and, furthermore considerably increase the stiffness of the belt which may disadvantageously affect the trough formation of the belt.

It would be advantageous to provide a reinforcement structure comprising one layer only, that is, a steel fabric which increases both the transverse strength and the resistance to shock, impact loading, and to longitudinal tearing.

According to the invention there is provided a fabric for reinforcing elastomeric or like plastics materials comprising a steel cord warp and a steel weft, in which the warp cords are substantially sinusoidal and possess an elongation capacity of between 1% and 2% at a load of 10% of the breaking load and the weft elements are substantially rectilinear.

Preferably, the angle $\alpha$ formed by the axes of warp cords with the neutral plane of the fabric at their intersection is between 6.5° and 12.5°.

Figure 1:
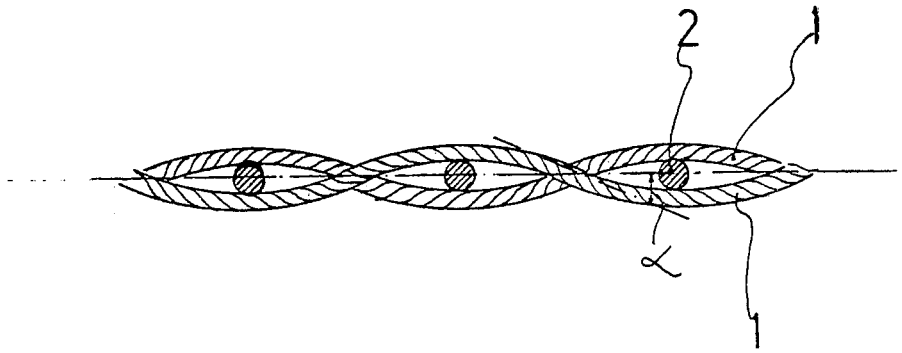
Figure 2:
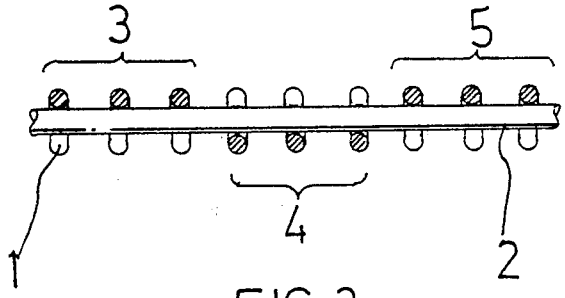
Figure 3:
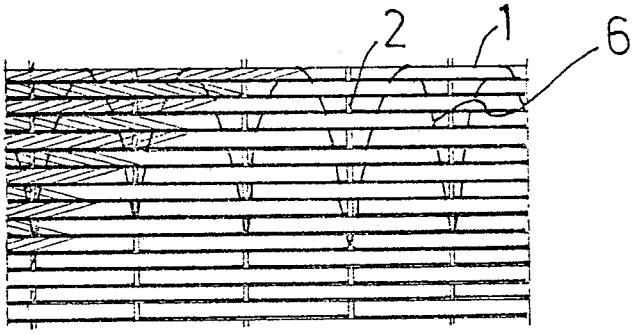

In order that the invention may be readily understood certain embodiments thereof will now be described by way of example with reference to the accompanying drawings in which:

FIG. 1 shows a longitudinal cross-section of a fabric in accordance with the invention, FIG. 2 is s transverse cross-sectional view of a further embodiment of fabric, and FIG. 3 illustrates a top view of a longitudinal fabric edge with edge binding.

The fabric shown in FIG. 1 comprises steel cords 1 in the warp direction and steel elements 2, for example steel wires or steel cords in the weft direction. The angle $\alpha$ formed by the axis line of the warp cords at the intersections with the neutral plane of the fabric must remain small. The sinusoidal deformation of the warp cords resulting from the weaving operation is indeed an elastic deformation leading to a transverse pressure exerted by the warp cords on the weft elements at the intersectional contact points. A sinusoidal deformation with an angle $\alpha$ greater than 12.5° would permit the transverse pressure to reach such a high level that there would be a danger of cord damage owing to mutual friction in these contact points (fretting). Moreover, it has appeared that too small a distance between successive weft elements makes the weaving operation difficult and slow, renders the fabric unnecessarily weighty and stiffens it in the transverse diection, whereas the longitudinal tearing strength is hardly improved. The longitudinal tensile strength of the fabric is reduced also. Therefore suitable limits are $6.5° \leqq \alpha \leqq 12.5°$ and preferably $8° \leqq \alpha \leqq 10°$.

The weft elements may be steel wires or steel cords whereby the latter offer the advantage of being more flexible. A steel cord construction of $0.30+6\times0.25$ (7 twisted wires in which the core wire has diameter of 0.30 mm and the sheath wires a diameter of 0.25 mm) in the weft appears to be very suitable and offers high longitudinal tearing strengths in cutting tests with sharp and particularly with relatively blunt cutting elements. It may also be advantageous to use a cord with a higher elongation capacity in the weft; for example, a construction $3\times7\times0.15$ (elongation approximately 2.5% at 10% of its breaking load). Yet a weft cord with an elongation over 3% (at a load of 10% of breaking load) leads to weaving difficulties. The latter type of cord ($3\times7\times0.15$) offers generally a better impact resistance and resistance to longitudinal tearing than the construction $0.3+6\times0.25$. Further, during embedment of the fabric in rubber during a calendering step the fabric is generally somewhat compressed to a lesser thickness and as a consequence the weft elements with a higher elongation capacity are thereby forced more easily from their rectilinear shape in a more or less wavy shape (running over and under adjacent warp cords) than less elastic weft elements.

In order to keep the thickness of the fabric minimal it has also appeared to be advantageous to use flat wires in the weft, for example with an elongate rectangular cross-section, whereby the longer side of the rectangle is parallel to the fabric plane (thickness 0.25 mm; wire width 1 mm).

Warp cord constructions with the suitable elongation characteristics generally have no core wire and they are preferably of the $3\times n$, $4\times n$, $5\times n$ type, whereby n preferably varies between 1 and 7 but may also be greater. The twisting direction in the bunched component strands of n wires is equal to that of the cord and the lay length is relatively long (for example 9 to 20 mm). In a bunching operation the cords are twisted together into a structure which is not very compact so that they open slightly after the weaving process. This greatly improves the rubber penetration into the cords which improves the anchorage and corrosion resistance of the reinforcing fabric in the rubber. As a result of the bunching process the tensile strength of the cord generally decreases compared with the intrinsic tensile strength of the wires. Thus, from the point of view of weight savings, it is advantageous to use wires with an initially high tensile strength in order to reach a sufficient tensile strength in the fabric with warp cords that are as thin as possible.

Various weaving patterns are possible. However, the twisting direction in juxtaposed wire cords preferably is alternately S lay, and Z lay respectively. The adjacent warp cords may alternately run over and under the same weft wire. However, it is also possible to dispose the warp cords in groups as illustrated in FIG. 2. The cross-sectional view of the fabric of FIG. 2 show groups 3, 4 and 5 of adjacent warp cords which alternately run over and under the same weft element 2. The maximum number of warp cords per group is preferably four. Also the weft elements may consist of, for example, groups of two juxtaposed cords.

To prevent unravelment of the fabric edges, warp and weft can be connected to each other at some of the contact points in the edge areas, for example by gluing. It is also possible to fit in a polyethylene wire instead of a warp cord in the longitudinal edge areas of the fabric, which wire can be glued to the weft elements at a number of contact points by local heating. Another method consists of insertion of a textile binding yarn 6 in the longitudinal fabric edges during weaving as illustrated in FIG. 3.

The fabric according to the invention is particularly suited for the reinforcement of rubber conveyor belts since the incorporation of one thin reinforcement layer with high tensile strength no creep and suitable elongation characteristics, is a simple operation and combines an optimal lateral stiffness and tearing strength to flexibility in the transverse belt direction. Thus drums with small diameters can be used for driving the belt.

Owing to their more or less open structure in the fabric, the warp cords can easily take up local axial compression stresses and tensile stresses both in manufacture (calendering, vulcanizing) and in use (shock loadings through for example pieces falling on the belt). In case of a longitudinal tensile load on the conveyor belt of ca. 10% of the breaking load of the warp cords, the belt generally still has an elongation capacity of approximately 0.5%.

During the manufacture of conveyor belts in the strength class of ST 500 to ST 2000 the required strength can be reached with warp cord diameters going from 1.25 mm to 3.8 mm. The number of cords per cm of fabric width varies between 0.5 to 5.

EXAMPLE 1

To reinforce a rubber conveyor belt with a width of 900 mm in the ST 630 strength class, a steel cord fabric was made with the following characteristics:

- warp cord construction: 4×4×0.22; 4 wires (with diameter 0.22 mm twisted together per strand and 4 strands twisted together in the same direction of the cord; lay length in the strand 9.5 mm and in the cord 1 mm; cord diameter 1.33 mm; cord elongation 1.3% at a load of 146 N (i.e. 10% of cord breaking load); brass-coated wire.
- weft cord construction: 7×0.25 brass-coated steel cord.
- fabric construction: width 875 mm 4.6 warp cords per cm of fabric width, juxtaposed warp cords alternately with S and Z lays and alternately running over and under the same weft cord; 73 weft cords per meter of fabric length so that $\alpha=9.5°$; fabric thickness 2.67 mm.

The longitudinal edges of the fabric were protected against unravelling by gluing the outermost warp cord at both edges to the weft in every eight contact point (Locttite IS 415—Activator IS 71). The reinforcing fabric was incorporated in a rubber conveyor belt by known calendering processes. After vulcanizing, a belt was obtained which was smooth and straight over its entire length. At a longitudinal tensile load of 10% of the breaking load of the warp cords, a longitudinal elongation of 0.5% was obtained which is an ideal working condition for conveyors. The belt thickness was 10 mm. The reinforced core layer therein had a thickness of about 3 mm and contained a rubber composition with good adhesion to steel cord. The top cover was composed of a rubber with good abrasion resistance and had a layer thickness of 5 mm whereas the bottom cover had a thickness of 2 mm.

The belt was cyclically stress loaded between 10% and 2% of the intrinsic tensile strength of the steel cord fabric for 30 min. (40 cycles). No creep elongation was observed after this test, i.e. the belt, under the above mentioned stress load 2%, was no longer than before the test and under the same stress load. A textile reinforced belt of the same strength range (type 4 EP 160) was submitted to the same test and here a creep elongation of 0.3% was registered.

The belt was also subjected to an impact test in which it was laid on a supporting surface under a stress load of 10% of its tensile strength. An impact object with a weight of 10 kg and with a spherical underside (radius 50 mm) was allowed to fall down five times from a height of 2.5 m on the same spot on the supported belt surface. The remaining tensile strength of a longitudinal beltstrip (width 2 cm) comprising the impact zone was measured and was found to amount to at least 95% of the belt tensile strength. This result is very favourable in comparison to test results on a textile reinforced belt 4 EP 160 which was subjected to the same impact test and where strength losses ranging between 18% and 57% were observed.

Steel weft elements also permit an easy mechanical connection of the belt ends by means of clamps or hooks.

It was observed that with conventional mechanical fasteners, such as Minet clamps, the strength of the jointing area amounted to 60% and more of the tensile strength of the belt. (Minet is a registered trademark of the General Splice Comp.).

EXAMPLE 2

A steel cord fabric was woven in view of reinforcement of a rubber conveyor belt in the strength class ST 1000. It had the following structural parameters:

- warp cord construction 4×7×0.22 (7 wires with diameter 0.22 mm twisted together with a lay length of 12.5 mm in the strand and four such strands twisted together in the same direction with a lay length of 16 mm;) cord diameter: 1.8 mm; brass coated wire.
- weft cord construction: 0.30+6×0.25 brass coated.
- steel cord fabric construction: width 1175 mm end count 4.5 warp cords per cm of fabric width; juxtaposed warp cords alternately with S resp. Z lays and running alternately over and under the same weft cord; distance between consecutive weft cords was about 18 mm so that again $\alpha=9.5°$ fabric thickness 3.5 mm.

The longitudinal edges of the fabric were protected against unravelling by inserting a binding yarn during weaving as illustrated in FIG. 3. The total thickness of the rubber belts was 11.5 mm with a top cover thickness of 6 mm and bottom cover thickness of 2 mm. The elongation of the belt, when submitted to a tensile load of 10% of the intrinsic tensile strength of the fabric, amounted to 0.6%. The belt was straight and had an even surface. It was tested as described in Example 1 and no creep elongation was observed. A strength loss of 0% was found after the impact test.

The fabric according to the invention may clearly also be applied to reinforce other elastomeric articles, for example driving belts, car tires and hoses. P.V.C. conveyor belts may also be advantageously reinforced with the described steel cord fabric. The polyvinyl chloride compound which then comes in contact with the steel fabric must therefore undergo some known treatment or contain additives in order to adhere sufficiently to the brass-coated or zinc-coated steel cord. This P.V.C. composition may for example contain an epoxy resin component. The steel fabric may of course also be embedded in a rubber layer and this reinforcing core layer may then be sandwiched between P.V.C. layers presenting good adhesion of the rubber core layer or optionally to an intermediate anchoring layer between the rubber and P.V.C. The main advantage of steel reinforcement in P.V.C. belts is to be found in the noninflammability of steel. P.V.C. belts are particularly used for their self-extinguishing nature, which is a fire safety requirement effective in mines.

It is also possible to embed the reinforcing fabric in an elastomer of plastics material which contains for example fibrous filler materials in order to further increase the tearing strength or belt stiffness, when and where desirable.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What we claim is:

1. A single ply woven fabric for reinforcing elastomeric or like plastic materials comprising a steel cord warp and a steel weft wherein the warp cords are substantially sinusoidal and have an elongation capacity of between 1% and 2% at a load of 10% of the breaking load and the weft elements are substantially rectilinear.

2. A fabric according to claim 1, in which the angle $\alpha$ formed by the axes of the warp cords with the neutral plane of the fabric at their intersection is between 6.5° and 12.5°.

3. A fabric according to claim 2 in which the said angle is between 8° and 10°.

4. A fabric according to claim 1 in which the weft elements are steel cords with an elongation capacity of less than 3% at a load of 10% of the cord breaking load.

5. A fabric according to claims 1, 2 or 3, in which the weft elements are steel wires with elongate rectangular cross-section, the longer side of the rectangle being parallel to the fabric plane.

6. A fabric according to claim 1 wherein the juxtaposed warp cords alternately have an S lay and a Z lay respectively.

7. A fabric according to claims 1, 2, 4 or 6 wherein the fabric warp comprises groups of juxtaposed warp cords which cords are provided substantially sinusoidal in phase in each group, whereas the sinusoidal course of the adjacent groups is in counterphase.

8. A fabric according to claim 7 in which the maximum number of warp cords per group is four.

9. An article of elastomeric or like plastics materials reinforced by a fabric according to claim 1.

10. An article according to claim 9 comprising a conveyor belt.

11. A conveyor belt according to claim 10 including a top cover layer and a bottom cover layer of polyvinylchloride.

* * * * *